United States Patent [19]

Senga et al.

[11] Patent Number: 4,520,088

[45] Date of Patent: May 28, 1985

[54] METHOD FOR MAKING PRINTING PLATES

[75] Inventors: Takao Senga; Jun Yamada; Shigeyoshi Suzuki, all of Nagaokakyo, Japan

[73] Assignee: Mitsubishi Paper Mills, Ltd., Tokyo, Japan

[21] Appl. No.: 457,281

[22] Filed: Jan. 11, 1983

[30] Foreign Application Priority Data

Jan. 14, 1982 [JP] Japan ..... 57-4157
Jan. 26, 1982 [JP] Japan ..... 57-10325
Feb. 13, 1982 [JP] Japan ..... 57-21824

[51] Int. Cl.[3] ..... G03G 13/28

[52] U.S. Cl. ..... 430/49; 430/114; 430/119

[58] Field of Search ..... 430/49, 114, 119

[56] References Cited

U.S. PATENT DOCUMENTS 3,788,995 1/1974 Stahly et al. ..... 430/114
3,874,896 4/1975 Machida et al. ..... 430/119
4,078,927 3/1978 Amidon et al. ..... 430/49 X
4,265,987 5/1981 Lawson ..... 430/49
4,357,406 11/1982 Kouchi et al. ..... 430/137
4,425,418 1/1984 Iwaki et al. ..... 430/106
4,461,818 7/1984 Suzuki et al. ..... 430/49
4,477,547 10/1984 Yamada et al. ..... 430/14

*Primary Examiner*—John E. Kittle
*Assistant Examiner*—José G. Dees
*Attorney, Agent, or Firm*—Cushman, Darby & Cushman

[57] ABSTRACT

Disclosed is a method for electrophotographically making a printing plate excellent in resolving power and having a high printing endurance by using a liquid developer containing a copolymer comprising an acrylate ester or methacrylate ester having an alkyl group of 4 or more and a styrene or a styrene derivative, preferably said copolymer additionally containing an acrylate ester or a methacrylate ester having an alkyl group of 3 or less carbon atoms, more preferably said binary or ternary copolymer additionally containing a vinyl monomer having a basic group or an acidic group.

15 Claims, No Drawings

METHOD FOR MAKING PRINTING PLATES

BACKGROUND OF THE INVENTION

This invention relates to a method for making a printing plate, wherein a toner image is electrophotographically formed by using a wet-type developer on an original printing plate comprising an electroconductive support and an organic photoconductive compound layer disposed thereon, then the image is fixed, and the non-image areas are removed by etching with an alkaline aqueous etching solution, leaving behind the toner image intact.

It is known that as the photosensitive material of a printing plate using electrophotographic image forming, use is made of a photosensitive element comprising paper, film, or aluminum sheet and, provided thereon, a coating layer of an inorganic photoconductive powder, such as zinc oxide or cadmium sulfide, dispersed in a suitable binder. To form an image and to convert the element to a printing plate by the electrophotographic technique, the element is subjected to corona discharge, exposure, and toner development, the resulting toner image being receptive to a greasy printing ink and the non-image areas becoming hydrophilic after hydrophilizing treatment. Although the toner image is obtained by either dry development or wet development, the latter is generally preferred because of better resolution of the image. In such a printing plate, however, since a large quantity of an inorganic photoconductive powder together with a binder is coated on a support in order to increase the sensitivity, it follows that a certain limitation is posed upon the surface smoothness, strength of the coating film, and the adhesiveness between the coating film and the support; with respect to the retention of sufficient hydrophilicity of the non-image areas there is a problem arising from the strength of the coating film. For these reasons, the printing plate is unsuitable for the long-run printing exceeding 10,000 copies, though it is satisfactory for the short-run printing.

There are also known many printing plates carrying organic photoconductive compounds, which are adaptable to electrophotographic treatment. As examples of such printing plates, mention may be made of those disclosed in Japanese Patent Publication Nos. 17,162/62, 6,961/63, 2,426/66 and 39,405/71; Japanese Patent application "Kokai" (Laid-open) Nos. 19,509/75, 19,510/75, 145,538/79, 89,801/79, 34,632/79, 19,803/79 and 105,244/80. In the printing plates disclosed by these patents, the photosensitive elements comprise electroconductive supports such as aluminum sheet and, disposed thereon, a coating of photoconductive compounds using a binder soluble in alkalis and/or alcohols such as styrene-maleic anhydride copolymer, vinyl acetate-crotonic acid copolymer, vinyl acetate-maleic anhydride copolymer, or phenolic resin, and the toner images are formed by subjecting the photosensitive elements to corona discharge, exposure, and toner development, said toner images serving as a resist layer in the subsequent removal of the coating layer in non-image areas by treating with an etching solution containing an alkali or alcohol as major component, thereby to produce a printing plate comprising the unremoved image areas and the non-image areas of hydrophilic surface of the aluminum support. A commercial product based on this principle has been offerred for practical use under the trade name of "Elefasol" by Kalle Co. The Elefasol system, however, utilizes a dry developer in forming the toner image and, as a consequence, is insufficient in resolving power. Even if use is made of a dry developer of finely subdivided particles, there is obtained a printing plate having a resolving power of only 3–5 lines/mm. As contrasted, the toner image formed by a wet developer has a resolution of 15–20 lines/mm. Although the toner image formed by the dry developer is inferior in resolving power owing to a larger size of toner particles, it has an advantage in that owing to a larger amount of fixed particles the thick toner image acts as a resist in the etching of non-image areas with an alkali and/or an alcohol, thus preventing, in most cases, the image areas from being etched. To the contrary, although superior in resolution and sharpness, the toner image formed by the wet developer is considerably smaller in thickness than that formed by the dry developer, thus detracting much from the effectiveness of toner image as a resist. As a consequence, the resolving power of the printing plate before etching is no longer retained after the etching. Therefore, it is also difficult to obtain a printing master of high resolving power even by the wet development.

Another problem generally accompanying the wet developer is the stability of dispersion. Since the wet developer is a dispersion of a resin, a dye or pigment, a charge regulator, and others in an organic solvent of low dielectric constant and high insulating property, the dispersion stability is an extremely important factor for the manufacturers of wet developers which requires utmost endeavor for the improvement. An especially difficult problem to be solved during the developmental stage of the present wet developer is to find a way of controlling such contradictory tendencies that a resin composition having an improved dispersion stability tends to be inferior in resist property, while that having an improved resist property tends to be inferior in dispersion stability.

SUMMARY OF THE INVENTION

The first object of this invention is to provide a wet developer which forms a toner image capable of exhibiting a high resistance to an alkaline etching solution in the aforementioned process for making a printing plate.

The second object of this invention is to provide a wet developer for use in making the aforementioned printing plate, which is excellent in dispersion stability and withstands a long-term use or storage.

The third object of this invention is to provide a method for making the aforementioned printing plate of the wet development type which has an excellent resolving power and a high printing endurance.

DESCRIPTION OF THE INVENTION

It was found by the present inventors that it is favorable to the achievement of the above objects to use as the resin component of the wet developer a copolymer containing (a) an acrylate ester or methacrylate ester having an alkyl group of 4 or more carbon atoms and (b) styrene or a styrene derivative. It is most preferable that the above copolymer contains a third monomeric unit having a basic or acidic group. The resin composition of the wet developer for use in the present printing plate is described below in detail.

The wet developer of this invention is a dispersion of a resin, a dye or pigment, and, if necessary, a charge regulator and so on in a solvent having a low dielectric constant and a high insulating property, into which the resin of this invention is insoluble, swellable, or soluble to a limited extent. The methacrylate or acrylate ester component having an alkyl group of 4 or more carbon atoms (hereinafter referred to briefly as the first component) is a component which solubilize the resin, while styrene or a styrene derivative (hereinafter referred to briefly as the second component) is a component which insolubilize the resin. By dispersing a pigment or dye and a charge regulator together with a copolymer of these two components into the above solvent, it was possible to prepare a wet developer of a fairly good dispersion stability. However, the toner image formed by the wet developer containing the binary copolymer resin was found to exhibit, in some cases, a very low resistance against an alkaline aqueous etching solution. As a result of an extensive study, such a phenomenon was found to occur markedly when a copolymer resin containing about 30 mole % or less of the second component was used. Although the optimum amount of the second component varies depending upon the number of carbon atoms of the alkyl group of the first component, the resist property of the resin becomes better with the increase in the second component content, except for an extremely high content, in which case the dispersion stability of the wet developer becomes deteriorated and unsuitable for the long-term use or storage. Although depending upon the type of the first component, the content of the second component should not exceed 90% by weight. A suitable content of the second component is in the range of from 35 to 80% by weight. If a $C_{4-8}$-alkyl ester or/and a third component alkyl ester (described later) are used, the lower limit can be decreased to about 30% by weight.

It was further found that the resist property and the dispersion stability are improved by copolymerizing as a third component a methacrylate ester or an acrylate ester having an alkyl group of 3 or less carbon atoms. The third component is used in an amount in the range of from 5 to 40% by weight. It is difficult to obtain a wet developer with a sufficient resist property by using a homopolymer of the third component. The first component is used in an amount in the range of from 5 to 60% by weight. When the numbers of carbon atoms in the alkyl groups of the first and third components are very near to each other such as when the first component is butyl ($C_4$) ester and the third component is propyl ($C_3$) ester, the advantage of this invention is more fully exhibited by using butyl acrylate for the butyl ester and propyl methacrylate for the propyl ester. For the purpose of further improvement, it is possible without any loss in the resist property to incorporate into the above binary or ternary copolymer a third or fourth component of copolymerizable monomer so far as the resin characteristics are not injured.

It was found that a printing plate of high resolving power and high printing endurance is obtained without any loss in the resist property by using as the copolymerizable monomer to be incorporated in the binary or ternary copolymer a vinyl monomer having an acidic group (e.g. carboxyl group) or a basic group as described later. It is desirable to incorporate such a monomer into the above ternary copolymer to obtain a quaternary or higher copolymer.

It is possible, if necessary, to use as a comonomer component an acrylamide or methacrylamide, a vinyl monomer having a hydroxyl or epoxy group, vinyl acetate, or a monomer having a halogen atom such as chlorine or fluorine in preparing the resin used in this invention.

As examples of alkyl groups of 4 or more carbon atoms in the acrylate esters or methacrylate esters as the first component of the resins for use in the present wet developers, mention may be made of n-butyl, isobutyl, tert butyl, n-amyl, pentyl, hexyl, 3-methylbutyl, 2-methylpentyl, 2-ethylbutyl, sec-amyl, tert-amyl, heptyl, octyl, 2-ethylhexyl, nonyl, decyl, dodecyl, tetradecyl, hexadecyl, and halogen-substituted alkyls such as, for example, 1,1,5-trihydroperfluoropentyl. This first component may comprise one or two or more of the esters. When at least one of the esters has an alkyl group of 4 to 8 carbon atoms, excellent results are obtained.

Examples of styrene and styrene derivatives used as the second component include alkyl-styrenes such as methylstyrene, ethylstyrene, and isopropylstyrene; halogenated styrenes such as chlorostyrene, bromostyrene, and fluorostyrene; alkoxystyrenes such as methoxystyrene, ethoxystyrene, and butoxystyrene; hydroxystyrenes such as p-hydroxystyrene and 3-methoxy-4-hydroxystyrene; carboxystyrenes and derivatives thereof such as vinylbenzoic acid and methyl vinylbenzoate; nitrostyrenes such as nitrostyrene and trinitrostyrenes; aminostyrenes such as m-aminostyrene and dimethylaminostyrene; sulfur-containing styrene derivatives such as ethyl p-vinylbenzenesulfonate; and $\alpha$- and $\beta$-substituted derivatives. These styrene derivatives are described in S. Murahashi et al. "Synthetic Polymer, II" (published by Asakura Publishing Co.).

Examples of alcohol moieties of acrylate esters or methacrylate esters containing alkyl groups of 3 or less carbon atoms used as the third components include methyl, ethyl, n-isopropyl, and isopropyl, which may have halogen atoms as substituents, e.g. 1,1,3-trihydroperfluoropropyl.

As copolymerizable monomers having acidic group, there may be added to the binary or ternary component, for example, acrylic acid, methacrylic acid, itaconic acid, crotonic acid, itaconic anhydride, maleic acid, maleic anhydride, half esters of maleic acid, fumaric acid, vinylsulfonic acid, and acrylamidopropanesulfonic acid. The monomer components having acidic groups are used preferably in an amount of 1 to 15% by weight.

The monomers having basic groups include diethylaminopropyl methacrylate, dimethylaminopropyl methacrylate, 4-vinylpyridine, 2-vinylpyridine, vinylimidazole, p-dimethylaminostyrene, and aminostyrenes. These monomers are used in an amount of 15% or less, preferably 10% or less, by weight.

Each of these components may comprise one or two or more monomers like the first component.

From the foregoing description and the examples given later, it will become apparent that by using the resins of abovementioned compositions, there is obtained a wet developer for printing plate, which exhibits excellent dispersion stability and a high resistance against an alkaline aqueous etching solution.

The solvents used in the present wet developer are organic solvents of low dielectric constant and high insulation resistance such as, for example, normal paraffin hydrocarbons, isoparaffin hydrocarbons, cycloaliphatic hydrocarbons, aromatic hydrocarbons, and halogenated aliphatic hydrocarbons. Of these hydrocarbons, especially preferred are isoparaffinic hydrocarbons such as, for example, "Shellsol 71 " (Shell Petroleum Co.), "Isopars G, H, K and L" (Esso Petroleum Co.), and "IP Solvent" (Idemitsu Petroleum Co.).

Examples of electric charge regulators preferably used in the present wet developer include copper oleate, cobalt naphthenate, zinc naphthenate, manganese naphthenate, cobalt octylate, lecithin, sodium dioctylsulfosuccinate, and aluminum salt of staybelite rosin.

The dyes or pigments preferably used in the present wet developer for the purpose of coloring are any of those known as colorants generally used in wet developers. As examples, mention may be made of oil-soluble azo dyes such as Oil Black and Oil Red; basic azo dyes such as Bismarck Brown and Chrysoidine; acid azo dyes such as Wool Black, Amido Black Green, and Blue Black HF; direct dyes such as Direct Deep Black E and Congo Red; anthraquinone dyes such as Sudan Violet and Acid Blue; carbonium dyes such as Auramine, Malachite Green, and Crystal Violet; rhodamine dyes such as Rhodamine B; and quinone imine dyes such as Safranine, Nigrosine, and Methylene Blue. Examples of pigments are Carbon black, Phthalocyanine Blue, Phthalocyanine Green, and Benzidine Yellow. Surface-treated pigments such as, for example, carbon black and graft carbon dyed with nigrosine, and silicon oxide fine powder dyed with Rhodamine B, Micro Lith Blue, etc., are also used. These dyes and pigments are used in a least possible amount, that is, 50% by weight or less based on the resin. The addition in an excessive amount causes deterioration in the dispersion stability and tends to decrease also the resist property.

The present wet developer provides a positively charged or negatively charged toner as required, by selecting the charge regulator, dye or pigment which are used in preferred embodiments.

It is desirable to add to the present wet developer a resin soluble in the solvent used in this developer, for the purpose of preparing, steadily and with desirable reproducibility, a developer suitable for the objects of this invention. The amount of the resin is generally about 10–200% by weight of said copolymer.

When a copolymer with a monomer having a basic group is used, there is added a resin soluble in the solvent and having an acid value of 50 or below, such as, for example, lauryl methacrylate-acrylic acid copolymer, stearyl methacrylate-methacrylic acid copolymer, or 2-ethylhexyl acrylate-crotonic acid copolymer. When a copolymer with a monomer having an acidic group is used, there is added a resin soluble in the solvent and having a basic group, such as, for example, stearyl methacrylate-diethylaminopropyl methacrylate copolymer, lauryl acrylate-vinylpyridine copolymer, lauryl acrylate-vinylimidazole copolymer, 2-ethylhexyl acrylate-dimethylaminoethyl acrylate copolymer, lauryl methacrylate-dimethylaminoethyl methacrylate copolymer.

For the purpose of improving the fixing property, a low-softening resin may be used in admixture with the resin of this invention. Examples of such low-softening resins include petroleum-based resins such as polybutadiene, polyisoprene, polyisobutylene, and polyethylene as well as those resins generally called rubbers, such as copolymers of styrene or acrylonitrile with monomers of said petroleum-based resins.

There are known various preparative techniques for wet developers, such as, for example, a technique in which a mixture of a colorant and a resin is dispersed in a solvent such as petroleum-base aliphatic hydrocarbon or a small amount of an aromatic hydrocarbon or a halogenated hydrocarbon by means of an attritor, ball mill, or Kady mill and the resulting concentrated toner is diluted with a solvent of a low dielectric constant and a high electrical insulation, a method in which a concentrated mixture of a colorant, resin, and charge regulator is added dropwise into an isoparaffinic solvent, while applying ultrasonic vibration, to obtain a wet developer, or a method in which monomers are polymerized in a high electrical insulating solvent of a low dielectric constant containing a colorant and a charge regulator to obtain a wet developer. This invention is, of course, not limited to any particular preparative method. Examples of reference resins (the figures in parentheses indicate percentages by weight):

A. Stearyl methacrylate/styrene (80/20)
B. Lauryl methacrylate/methyl methacrylate (50/50)
C. Styrene/n-butyl acrylate (95/5)
D. Stearyl methacrylate/vinyltoluene/ethyl methacrylate (30/20/50)
E. Lauryl methacrylate/styrene/diethylaminoethyl methacrylate (70/25/5)
F. Butyl acrylate/α-methylstyrne/acrylic acid (70/20/10)

Examples of the present resins (the figures in parentheses indicate percentages by weight):

1. Butyl acrylate/styrene/ethyl methacrylate (25/60/15)
2. Lauryl methacrylate/vinyl toluene/methyl methacrylate (10/70/20)
3. Lauryl methacrylate/styrene/methyl acrylate (30/50/20)
4. Ethylhexyl acrylate/styrene/methyl methacrylate (20/40/40)
5. Ethylhexyl acrylate/α-methylstyrene/ethyl methacrylate (10/70/20)
6. Stearyl methacrylate/styrene/isopropyl acrylate (20/50/30)
7. Stearyl methacrylate/vinyltoluene/propyl methacrylate (40/50/10)
8. Butyl methacrylate/vinyltoluene/methyl methacrylate (45/50/5)
9. Isobutyl methacrylate/vinyltoluene/ethyl acrylate (30/40/30)
10. Butyl acrylate/styrene/propyl methacrylate (35/40/25)
11. Butyl acrylate/α-methylstyrene/isopropyl acrylate (30/60/10)
12. Stearyl methacrylate/styrene/methyl methacrylate/diethylaminoethyl methacrylate (20/60/15/5)
13. Lauryl methacrylate/vinyltoluene/ethyl acrylate/-dimethylaminoethyl methacrylate (30/50/15/5)
14. Butyl methacrylate/styrene/methyl acrylate/vinylpyridine (20/40/35/5)
15. Butyl acrylate/α-methylstyrene/isopropyl acrylate/vinylimidazole (30/45/22/3)
16. Stearyl methacrylate/styrene/ethyl methacrylate/-hydroxyethyl methacrylate (20/50/20/10)
17. Butyl acrylate/styrene/ethyl methacrylate/glycidyl methacrylate (20/55/20/5)
18. Lauryl methacrylate/styrene/ethyl methacrylate/acrylic acid (20/60/15/5)
19. Lauryl methacrylate/vinyltoluene/methyl methacrylate/crotonic acid (25/45/25/5)
20. Stearyl acrylate/α-methylstyrene/methyl methacrylate/itaconic acid (40/40/15/5)
21. Stearyl methacrylate/styrene/methyl acrylate/methacrylic acid (12/80/5/3)

22. Butyl acrylate/styrene/propyl methacrylate/acrylic acid (25/55/15/5)
23. Butyl methacrylate/styrene/methyl methacrylate/-methacrylic acid (25/50/15/10)
24. n-Butyl methacrylate/styrene (40/60)
25. Ethylhexyl acrylate/α-methylstyrene (40/60)
26. Ethylhexyl acrylate/n-butyl acrylate/styrene (30/20/50)
27. Lauryl methacrylate/vinyltoluene/diethylaminoethyl methacrylate (40/50/1)
28. Lauryl methacrylate/n-butyl acrylate/styrene/acrylic acid (25/10/60/5)
29. Stearyl acrylate/ethylhexyl acrylate/styrene/itaconic acid (30/10/57/3).

These resins are easily synthesized in a well-known manner by block polymerization, solution polymerization, or suspension polymerization using as polymerization initiator a peroxide or an azo compound. A resin having a molecular weight in the range of from 5,000 to 1,000,000 may be used. If a low molecular-weight resin is used the resistance against the etching solution tends to be inferior, whereas if a resin of excessively high molecular weight is used, difficulties will be encountered in preparing the wet developer. A most preferable molecular weight is in the range of from about 10,000 to about 300,000. The molecular weight can be easily regulated in a known manner by properly selecting the initiator concentration, molecular-weight regulator, polymerization temperature, and monomer concentration. The molecular weights of the above resin examples were about 100,000, as determined by gel permeation chromatography.

The binder forming a photosensitive layer containing an organic photoconductive compound in the original printing plate which is developed by the wet developer of this invention should be soluble in the alkaline aqueous etching solution. It is also desirable that the binder may retain sufficient adhesiveness to the toner image formed by the wet development and subsequent fixing. Such binders for forming a photosensitive layer include styrene-maleic anhydride copolymer, styrene-maleic anhydride half ester copolymer, maleic acid resin formed by the reaction between rosin and maleic anhydride, vinyl acetatecrotonic acid copolymer, phenol resin, vinyl acetatemaleic anhydride copolymer, and acrylate or methacrylate ester resin having an acid value of about 50 or above.

As examples of the organic photoconductive compounds used in the present printing plate, mention may be made of the following compounds:

a. Aromatic tertiary amino compounds: triphenylamine, diphenylbenzylamine, di-(β-naphthyl)benzylamine, and diphenylcyclohexylamine;
b. Aromatic tertiary diamino compounds: N,N,N′,N′-tetrabenzyl-p-phenylenediamine, N,N,N′,N′-tetrabenzylbenzidine, 1,1′-bis(4-N,N-dibenzylaminophenyl)ethane, 2,2-bis-(4-N,N-dibenzylaminophenyl)butane, bis-[4-N,N-di-(p-chlorobenzylaminophenyl)]methane, 3,3-diphenylallylidene-4,4′-bis-(N,N-diethyl-m-toluidine), and 4,4′-bis(di-p-tolylamino)-1,1,1-triphenylethane;
c. Aromatic tertiary triamino compounds: 4,4′,4′-tris(-diethylaminophenyl)methane, 4-dimethylamino-4′,4″-bis(diethylamino)-2,2″-dimethyltriphenylmethane;
d. Condensation products: condensation product of an aldehyde and an aromatic amine, reaction product of an aromatic tertiary amine and an aromatic halogen compounds, poly-p-phenylene-1,3,4-oxadiazole, reaction product of formaldehyde and a condensed polycyclic compound;
e. Metal-containing compounds: 2-mercaptobenzothiazole zinc salt, 2-mercaptobenzoxazole lead salt, 2-mercapto-6-methoxybenzimidazole lead salt, o-hydroxyquinoline aluminum salt, 2-hydroxy-4-methylazobenzene copper salt;
f. Polyvinylcarbazole compounds: polyvinylcarbazole, halogen-substituted polyvinylcarbazole, vinylcarbazole-styrene copolymer, and vinylanthracenevinylcarbazole copolymer; and
g. Heterocyclic compounds: 1,3,5-triphenylpyrazoline, 1-phenyl-3-(p-dimethylaminostyryl)-5-(p-dimethylaminophenyl)pyrazoline, 1,5-diphenyl-3-styrylpyrazoline, 1,3-diphenyl-5-styrylpyrazoline, 1,3-diphenyl-5-(p-dimethylaminophenyl)pyrazoline, 3-(4′-dimethylaminophenyl)-5,6-di-(4″-methoxyphenyl)-1,2,4-triazine, 3-(4′-dimethylaminophenyl)-5,6-dipyridyl-1,2,4-triazine, 2-phenyl-4-(4′-dimethylaminophenyl)quinazoline, 6-hydroxy-2,3-di-(p-methoxyphenyl)benzofuran, and 2,5-bis-[4-ethylaminophenyl(1′)]-1,3,4-oxadiazole.

A printing plate of good quality is obtained also by using as the organic photoconductive compound one of the pigments such as phthalocyanine pigments, quinacridone pigments, indigo pigments, cyanine pigments, perylene pigments, binsbenzimidazole pigments, quinone pigments, azo pigments.

The base for the present printing plate may be any of the known bases for use in printing plates. Examples of such base materials include sheet metals such as aluminum sheet, zinc sheet, magnesium sheet, and copper sheet; film and synthetic paper materials of polyester, cellulose acetate, polystyrene, polycarbonate, polyamide, or polypropylene; and converted paper such as resin coated paper. Since the surface of the base of non-image areas produced after image formation and removal of the photoconductive compound together with the binder should be hydrophilic, it is necessary to subject the hydrophobic surface of the base to hydrophilization treatment. Metal sheets, especially aluminum sheets are most preferred, but the surface should preferably be subjected to surface treatments such as graining, alkali treatment, acid treatment, or anodic oxidation. Film materials are either coated with a polymer having a comparatively high hydrophilicity and subsequently crosslinked or applied with a metal coating by vapor coating or cladding. An insulating base material should preferably be subjected to an electroconductive treatment on the surface.

The original printing plate is prepared by dissolving a photoconductive compound and the binder of this invention in a solvent (in case the photoconductive compound is not soluble in the solvent, a suspension is prepared by means of a colloid mill, homogenizer, or ultrasonic dispersion device), adding a sensitizing dye, applying the resulting mixture onto the above-mentioned support (base) at a coverage of 1 to 30μ in thickness, and drying. The support may have an undercoat removable by etching. It is possible to prepare an original printing plate of the separate function type comprising superposed charge carrier generating layer and charge carrier transport layer.

The solvents suitable for use are those organic solvents which can dissolve the binder and the photoconductive compound or suspend the latter. As examples, mention may be made of alcohols such as methanol, ethanol, propanol, butanol, and hexyl alcohol; "Cellosolves" such as methyl, ethyl, or butyl "Cellosolves"; cyclic ethers such as dioxane and tetrahydrofuran; esters such as ethyl acetate, butyl acetate, and amyl acetate; ketones such as acetone, methyl isobutyl ketone, and methyl ethyl ketone; dimethylformamide, dimethyl sulfoxide, and halogenated hydrocarbons. In view of the solubility, cost, and safety, a mixture of 2 or more solvents is frequently used.

The printing plate of this invention is prepared by electrophotographically forming a toner image on the original printing plate and etching the non-image areas with an aqueous alkali solution or an aqueous alkali solution containing an alcohol. Suitable alkalis include sodium hydroxide, potassium hydroxide, sodium carbonate, sodium silicate, sodium phosphate, potassium phosphate, and ammonia. Suitable alcohols are lower alcohols and aromatic alcohols such as methanol, ethanol, propanol, benzyl alcohol, phenethyl alcohols; ethylene glycol, diethylene glycol, triethylene glycol, polyethylene glycol, and "Cellosolves".

Although the etching can be performed with an aqueous alkali solution alone, it is preferable to use an amino alcohol such as diethanolamine or triethanolamine in view of the rate of etching, safety, and hygiene. From the viewpoint of either resolution or image reproducibility, a combination of an amino alcohol and a simple alcohol is most preferable. When water washing treatment and a treatment with diluted aqueous acid solution are conducted after the etching treatment, printing plates causing no scumming during printing and excellent in image reproducibility are obtained.

Examples of etching solution.

| | | |
|---|---|---|
| 1. | EDTA-4H | 3 g |
| | Benzyl alcohol | 30 g |
| | Monoethanolamine | 5 g |
| | Triethanolamine | 50 g |
| | Potassium hydroxide | 20 g |
| | Reaction product of formalin and sodium sulfite | 2 g |
| | Made up with water to | 1 liter |
| 2. | Sodium hexametaphosphate | 3 g |
| | Phenethyl alcohol | 30 g |
| | Monoethanolamine | 50 g |
| | Reaction product of formalin and sodium sulfite | 2 g |
| | Made up with water to | 1 liter |

EXAMPLE 1

Preparation of original printing plate (a) Into a mixture of 100 g of butyl acetate and 20 g of butanol, was dissolved 10 g of an ethyl methacrylate/-butyl methacrylate/acrylic acid (50/30/20 in weight ratio) copolymer as a binder. Into the resulting solution, was dissolved 8 g of 1,3,5-triphenylpyrazoline as an organic photoconductive compound. After addition of 5 cc of a 1-% Rhodamine B (a sensitizing dye) solution in dimethylformamide, the mixture was made up to 150 g with butyl acetate. The resulting composition was coated by means of a wire bar on an aluminum sheet, 250$\mu$ in thickness, which had been subjected to graining and anodic oxidation, at a coverage of 5 g/m$^2$ on solids basis and dried to obtain an original printing plate [A].

(b) Into a mixed solvent of 80 g of xylene, 20 g of butanol, and 20 g of tetrahydrofuran, was dissolved 10 g of an octyl half ester (acid value 165) of styrene maleic anhydride as a binder and then dissolved therein 8 g of 2,5-bis-(4'-diethylaminophenyl)1,3,4-oxadiazole as an organic photoconductive compound. After addition of 5 cc of a 1% Ethyl Violet (a sensitizing dye) solution in methanol, the mixture was made up to 150 g with xylene. The resulting composition was coated and treated in the same manner as in (a) above to obtain an original printing plate [B].

(c) A mixture of 10 g of m-cresol-formaldehyde resin as a binder, 2 g of $\epsilon$-type copper phthalocyanine as an organic photoconductive compound, 40 g of xylene, and 140 g of butanol was treated in a ball mill for 3 hours. The resulting dispersion was coated and treated as in (a) above to obtain an original printing plate [C].

Preparation of wet developer (i) A mixture of 4 g of a copolymer resin example (8) enumerated hereinbefore for wet developer, 0.4 g of a carbon black surface treated with a colorant [nigrosine/MA-100 (Mitsubishi Chemical Co.) = 1/10], 15 g of xylene, 13 g of Isopar G, and 0.04 g of cobalt naphthenate, a charge regulator, was treated in attritor for 2 hours to obtain a dispersion of concentrated toner. The concentrated toner was gradually added dropwise to 1 liter of Isopar G and the resulting mixture was made up to 1.5-liters with Isopar G to obtain a wet developer (A).

(ii) The following wet developers were prepared in the same manner as in (i) above, except that various resins and colorants were used.

| Wet developer No. | Colorant | Resin No. |
|---|---|---|
| (B) | The same as in (i) | (4) |
| (C) | " | (7) |
| (D) | " | (10) |
| (E) | " | (12) |
| (F) | " | (14) |
| (G) | " | (16) |
| (H) | " | Reference (A) |
| (I) | " | Reference (B) |
| (J) | The same as in Example (a) | Reference (C) |
| (K) | " | Reference (D) |
| (L) | " | Reference (E) |
| (M) | Oil Black FS | (7) |
| (N) | " | (12) |

(iii) Below are shown examples wherein mixtures of two resins were used in order to further improve the dispersion stability and the fixing property. Each developer was prepared in a manner similar to that in (i) above. In each case, amount of the resin mixed with the numbered resin was 3 g and the colorant was Oil Black FS.

| Wet developer No. | Resin |
|---|---|
| (O) | Resin example (12) and stearyl methacrylate/acrylic acid (95/5) copolymer |
| (P) | Resin example (13) and lauryl methacrylate/methacrylic acid (97/3) copolymer |
| (Q) | Resin example (15) and the same copolymer as used in (P) |
| (R) | Resin example (2) and polybutadiene resin |
| (S) | Resin example (6) and polyisoprene resin |

Each original printing plate obtained in (a), (b) and (c) was negatively charged in dark place under −6 kV corona discharge and exposed to a positive image under white light. The exposed plate was immediately developed with a wet developer obtained in (i), (ii) and (iii), and the image was thermally fixed in a fuser. The developed plate was dipped in the above-mentioned etching solution for about 30 seconds to remove the coating in non-image areas, thereby to obtain a printing plate. The resist property of the toner image areas was evaluated by measuring the resolving power.

The same toners as those obtained in (i), (ii) and (iii) were prepared on an enlarged scale of each 3 liters. Each toner was tested for the dispersion stability by using the development section of a printing plate processor EP-11 of Mitsubishi Diafax Master (made by Mitsubishi Paper Mills Co.). Only the development section of EP-11 was operated and the toner was circulated at high speed for about one hour to observe the agglomeration. Another sample of the wet developer was left standing for one month to examine the change in dispersion stability with time. The results obtained are as shown in Table 1.

TABLE 1

| Run No. | Original plate | Wet developer | Etching solution | Resolving power (number of lines per mm) | Dispersion stability of wet developer EP-11 | Dispersion stability of wet developer Stationary |
|---|---|---|---|---|---|---|
| 1 | [A] | (A) | (2) | 15–17 | Good | Good |
| 2 | " | (B) | " | " | " | " |
| 3 | " | (D) | " | " | " | " |
| 4 | " | (F) | " | 12–14 | " | " |
| 5 | " | (M) | " | 15–17 | " | " |
| 6 | " | (N) | (1) | 18–20 | " | " |
| 7 | " | (O) | " | " | " | " |
| 8 | " | (P) | (2) | 15–17 | " | " |
| 9 | " | (J) | " | " | Coarse agglom. | Precipitate in large amount |
| 10 | " | (K) | " | 2–4 | Good | Good |
| 11 | [B] | (A) | " | 15–17 | " | " |
| 12 | " | (B) | " | " | " | " |
| 13 | " | (C) | (1) | " | " | " |
| 14 | " | (E) | " | 18–20 | " | " |
| 15 | " | (M) | " | 15–17 | " | " |
| 16 | " | (R) | " | 18–20 | " | " |
| 17 | " | (Q) | (2) | 15–17 | " | " |
| 18 | " | (H) | " | 2–4 | " | " |
| 19 | " | (I) | " | 1–2 | Coarse agglom. | Precipitate in large amount |
| 20 | " | (L) | (1) | 2–4 | Good | Good |
| 21 | [C] | (A) | " | 15–17 | " | " |
| 22 | " | (E) | " | " | " | " |
| 23 | " | (G) | " | 10–12 | " | " |
| 24 | " | (P) | " | 15–17 | " | " |
| 25 | " | (J) | " | " | Coarse agglom. | Precipitate in large amount |

From the results shown in Table 1, it is seen that when the reference resins were used, the resolving power is inferior due to a high resistance against the etching solution. Some of the reference resins showed a fair resolving power, but were too inferior in dispersion stability to be of any use in practice. Some resins other than those of this invention gave wet developers of good dispersion stability, but are poor in resist property and unsuitable for use in the present printing plate.

EXAMPLE 2

The procedure of Example 1 was repeated, except that the following wet developers were used.

| Wet developer No. | Colorant | Resin |
|---|---|---|
| (A) | The same as in (i) of Ex. 1 | (18) |
| (B) | The same as in (i) of Ex. 1 | (19) |
| (C) | The same as in (i) of Ex. 1 | (20) |
| (D) | The same as in (i) of Ex. 1 | (21) |
| (E) | The same as in (i) of Ex. 1 | (22) |
| (F) | The same as in (i) of Ex. 1 | (23) |
| (G) | The same as in (i) of Ex. 1 | Ref. (F) |
| (H) | Oil Black FS | (18) |
| (I) | " | (20) |
| (J) | " | (22) |

Below are shown examples in which two resins were mixed for the purpose of further improving the dispersion stability and the fixing ability. Each developer was prepared in a manner similar to that in (i) of Example 1. In each case, amount of the resin mixed with the numbered resin was 3 g and the colorant was Oil Black SF.

(K) Resin (18) and lauryl methacrylate/dimethylaminoethyl methacrylate (90/10)

(L) Resin (20) and the same copolymer as used in (K) (90/10)

(M) Resin (22) and the same copolymer as used in (K) (90/10).

Each original printing plate obtained in Example 1 (a), (b) and (c) was negatively charged under the application of corona discharge at −6 KV in dark place and exposed to a positve image under white light. The exposed plate was immediately developed with a wet developer of (A) to (M) and thermally fixed in a fuser. The plate was dipped in the above-mentioned etching solution for about 30 seconds to remove the coating in non-image areas leaving behind the toner image, whereby a printing plate was obtained. The evaluation was performed as in Example 1. The results obtained are as shown in Table 2.

TABLE 2

| Original plate | Wet developer | Etching solution | Resolving power (number of lines per mm) | Stability of wet developer EP-11 | Stability of wet developer Stationary |
|---|---|---|---|---|---|
| [A] | (A) | (2) | 15–17 | Good | Good |
| " | (B) | " | 13–15 | " | " |
| " | (C) | " | 12–14 | " | " |
| " | (D) | " | 15–17 | " | " |
| " | (E) | " | " | " | " |
| " | (F) | " | " | " | " |
| " | (G) | " | 2–4 | " | " |
| " | (H) | " | 15–17 | " | " |
| " | (I) | " | 12–14 | " | " |
| " | (J) | " | 15–17 | " | " |
| " | (K) | " | " | " | " |
| " | (L) | " | " | " | " |
| " | (M) | " | " | " | " |
| " | (A) | (1) | " | " | " |
| " | (C) | " | 12–14 | " | " |
| " | (E) | " | 15–17 | " | " |
| " | (I) | " | 12–14 | " | " |
| " | (L) | " | 15–17 | " | " |

TABLE 2-continued

| Original plate | Wet developer | Etching solution | Resolving power (number of lines per mm) | Stability of wet developer EP-11 | Stationary |
|---|---|---|---|---|---|
| [B] | (A) | " | " | " | " |
| " | (C) | " | 12–14 | " | " |
| " | (I) | " | " | " | " |
| " | (L) | " | 15–17 | " | " |
| [C] | (A) | " | 14–16 | " | " |
| " | (I) | " | 12–14 | " | " |
| " | (L) | " | 14–16 | " | " |

From the results shown in Table 2, it is seen that when a reference resin was used, the printing plate became inferior in resolving power due to a low resistance to the etching solution.

EXAMPLE 3

The following wet developers were prepared in the same manner as in Example 1 (i), except that other resins were used.

| Developer | Resin |
|---|---|
| 1 | (24) |
| 2 | (25) |
| 3 | (26) |
| 4 | (27) |
| 5 | (28) |
| 6 | (29) |
| 7 | (27) mixed with 1 g of SA* |
| 8 | (28) mixed with 1 g of LA* |

Note:
SA stands for stearyl methacrylate/methacrylic acid copolymer (95/5 by weight).
LA stands for lauryl methacrylate/dimethylaminoethyl methacrylate copolymer (95/5 by weight).

The evaluation results are as shown in Table 3.

TABLE 3

| Developer | Resolving power (number of lines per mm) | Stability of developer EP-11 | Stationary |
|---|---|---|---|
| 1 | 15–17 | Good | Good |
| 2 | " | " | " |
| 3 | 12–13 | " | " |
| 4 | 13–15 | " | " |
| 5 | 15–17 | " | " |
| 6 | " | " | " |
| 7 | " | " | " |
| 8 | " | " | " |

Although inferior in stability to the wet developers prepared in Examples 1 and 2, those prepared in the present Example have sufficient stability and show good performance as a resist.

What is claimed is:

1. A method for making a printing plate which comprises charging an original printing plate comprising an electroconductive base and, provided thereon, at least a layer containing an organic photoconductive compound, exposing the charged plate, developing the exposed element with a liquid developer containing a copolymer comprising 5 to 60% by weight of an acrylate ester or methacrylate ester having an alkyl group of 4 or more carbon atoms, 30 to 90% by weight of a styrene or a styrene derivative and 5 to 40% by weight of an acrylate ester or a methacrylate ester having an alkyl group of 3 or less carbon atoms to form a toner image, fixing the toner image and removing the layer of the non-image areas by etching it with an alkaline etching solution.

2. A method for making a printing plate according to claim 1 wherein the amount of the styrene or styrene derivative is 35 to 80% by weight.

3. A method for making a printing plate according to claim 1 herein the copolymer additionally contains 1 to 15% by weight of a vinyl monomer having a basic group.

4. A method for making a printing plate according to claim 1 wherein the copolymer additionally contains 1 to 15% by weight of a vinyl monomer having an acidic group.

5. A method for making a printing plate according to claim 1 wherein at least one of the acrylate ester or methacrylate ester of the first component has an alkyl group of 4 to 8 carbon atoms.

6. A method for making a printing plate according to claim 3 wherein the liquid developer additionally contains a resin soluble in a solvent and having an acid value of 50 or below.

7. A method for making a printing plate according to claim 4 wherein the liquid developer additionally contains a resin soluble in a solvent and having a basic group.

8. A method for making a printing plate which comprises charging a photosensitive printing element comprising an electroconductive base sheet and, provided thereon, at least a layer containing an organic photoconductive compound, exposing the charged element, developing the exposed element with a liquid developer containing a copolymer comprising 5 to 60% by weight of an acrylate ester or methacrylate ester having an alkyl group of 4 or more carbon atoms and 90% by weight or less of a styrene or a styrene derivative to form a toner image, fixing the toner image and removing the layer of the non-image areas by etching it with an alkaline etching solution.

9. A method for making a printing plate according to claim 8 wherein the amount of the styrene or styrene derivative is 30 to 90% by weight and at least one of the acrylate ester or methacrylate ester has an alkyl group of 4 to 8 carbon atoms.

10. A method for making a printing plate according to claim 8 wherein the copolymer additionally contains 1 to 15% by weight of a vinyl monomer having a basic group.

11. A method for making a printing plate according to claim 8 wherein the copolymer additionally contains 1 to 15% by weight of a vinyl monomer having an acidic group.

12. A method for making a printing plate according to claim 10 wherein the liquid developer additionally contains a resin soluble in a solvent and having an acid value of 50 or below.

13. A method for making a printing plate according to claim 11 wherein the liquid developer additionally contains a resin soluble in a solvent and having a basic group.

14. A method for making a printing plate according to claim 1 wherein the base sheet is an aluminum sheet.

15. A method for making a printing plate according to claim 8 wherein the base sheet is an aluminum plate.

* * * * *